US009115622B2

(12) United States Patent
Baier et al.

(10) Patent No.: US 9,115,622 B2
(45) Date of Patent: Aug. 25, 2015

(54) HEATING MODULE FOR AN EXHAUST-GAS PURIFICATION SYSTEM

(75) Inventors: Bettina Baier, Menden (DE); Bernd Maurer, Menden (DE); Klaus Schrewe, Menden (DE); Frank Noack, Menden (DE); Thomas Kästner, Menden (DE)

(73) Assignee: HJS Emission Technology GmbH & Co. KG, Menden (DE)

( * ) Notice: Subject to any disclaimer, the term of this patent is extended or adjusted under 35 U.S.C. 154(b) by 0 days.

(21) Appl. No.: 14/005,624

(22) PCT Filed: Mar. 26, 2012

(86) PCT No.: PCT/EP2012/055313

§ 371 (c)(1),
(2), (4) Date: Sep. 17, 2013

(87) PCT Pub. No.: WO2012/130796

PCT Pub. Date: Oct. 4, 2012

(65) Prior Publication Data

US 2014/0013729 A1 Jan. 16, 2014

(30) Foreign Application Priority Data

Mar. 28, 2011 (DE) ..... 20 2011 000 703 U

(51) Int. Cl.
*F01N 3/10* (2006.01)
*F01N 3/08* (2006.01)
(Continued)

(52) U.S. Cl.
CPC *F01N 3/08* (2013.01); *F01N 3/025* (2013.01); *F01N 3/0256* (2013.01);
(Continued)

(58) Field of Classification Search
CPC ..... F02D 41/029; F01N 9/002; F01N 3/0842; F01N 3/035; F01N 3/26; F01N 3/38; F01N 3/025; F01N 3/027; F01N 13/02; F02B 3/38
USPC ..... 60/286, 287, 288, 295, 300, 303
See application file for complete search history.

(56) References Cited

U.S. PATENT DOCUMENTS 3,209,531 A * 10/1965 Morris et al. ..... 60/274
3,744,249 A * 7/1973 August ..... 60/286
(Continued)

FOREIGN PATENT DOCUMENTS

DE 202009005251 12/2009
JP 62063114 A * 3/1987 ..... F01N 3/02
WO WO 2008147064 A1 * 12/2008 ..... F01N 3/20

OTHER PUBLICATIONS

International Search Report in International application No. PCT/EP2012/055313 mailed on Jun. 11, 2012. (2 pages—see entire document).

(Continued)

*Primary Examiner* — Thomas Denion
*Assistant Examiner* — Patrick Maines
(74) *Attorney, Agent, or Firm* — Margaret Polson; Polson Intellectual Property Law, PC

(57) ABSTRACT

A heating module (1) for an exhaust-gas purification system connected to the outlet of an internal combustion engine comprises a catalytic burner, with an HC injector (14) and with an oxidation catalytic converter (12) positioned downstream of the HC injector (14) in the flow direction of the exhaust gas, for supplying thermal energy to an exhaust-gas purification unit of the exhaust-gas purification system. It is provided here that the heating module (1) has a main section (2), a secondary section (3) which comprises the catalytic burner (12, 14), and a device (4, 5) for controlling the exhaust-gas mass flow flowing through the secondary section (3). In a first embodiment, the main section (2) has, in the inlet region or the heating module (1), an overflow pipe portion (6) which has overflow openings (7), between which overflow diverting chambers (8) is situated, parallel to the main section (2) of the heating module (1), the secondary section portion (11) with the oxidation catalytic converter (12). In another embodiment, it is provided that the secondary section (3) has, at the inlet side and outlet side, in each case one diverting chamber (8) which extends in the radial direction from the main section (2), between which diverting chambers (8) is situated, parallel to the main section (2) of the heating module (1), the secondary section portion (11) with the oxidation catalytic converter (12).

20 Claims, 6 Drawing Sheets

(51) Int. Cl.
*F01N 3/025* (2006.01)
*F01N 3/20* (2006.01)

(52) U.S. Cl.
CPC ..... *F01N 3/2053* (2013.01); *F01N 2240/14* (2013.01); *F01N 2240/16* (2013.01); *F01N 2410/00* (2013.01); *F01N 2470/02* (2013.01); *F01N 2610/03* (2013.01)

(56) References Cited

U.S. PATENT DOCUMENTS 4,106,287 A * 8/1978 Auclair et al. ..... 60/274
4,449,362 A 5/1984 Frankenberg et al.
4,485,621 A * 12/1984 Wong et al. ..... 60/274
4,969,328 A * 11/1990 Kammel ..... 60/275
2003/0217739 A1 * 11/2003 Saeki et al. ..... 123/543
2004/0139739 A1 * 7/2004 Kagenishi ..... 60/289
2011/0061369 A1 * 3/2011 Yetkin et al. ..... 60/282

OTHER PUBLICATIONS

Written Opinion in International application No. PCT/EP2012/055313 mailed on Oct. 10, 2013. (8 pages—see entire document).

* cited by examiner

HEATING MODULE FOR AN EXHAUST-GAS PURIFICATION SYSTEM

BACKGROUND

The invention relates to a heating module for an exhaust-gas purification system connected to the outlet of an internal combustion engine. The heating module comprises a catalytic burner, an HC injector and an oxidation catalytic converter positioned downstream of the HC injector in the flow direction of the exhaust gas. The oxidation catalytic converter supplies thermal energy to an exhaust-gas purification unit of the exhaust-gas purification system. The heating module has a main section, a secondary section which comprises the catalytic burner, and a device for controlling the exhaust-gas mass flow flowing through the secondary section.

Internal combustion engines today, diesel engines in particular, comprise control units that are connected in the exhaust gas system in order to reduce harmful or undesired emissions. Such a control unit can be, for example, an oxidation catalytic converter, a particle filter and/or a selective catalytic reduction (SCR) stage. A particle filter is used to collect soot particles discharged by the internal combustion engine. The soot that is present in the exhaust gas accumulates on the upstream side surface of the particle filter. In order to prevent an excessive increase in the exhaust gas counter pressure during the course of the successive soot accumulation and/or to prevent the risk of clogging the filter, a regeneration process is triggered when the soot load of the particle filter reaches a sufficient level. In such a regeneration process, the soot that accumulates on the filter is burnt off (oxidized). After the completion of such a soot oxidation, the particle filter is regenerated. Only a noncombustible ash residue remains. For a soot oxidation to occur, the soot must be at a certain temperature. As a rule, this temperature is approximately 600° C. The temperature at which such a soot oxidation starts can be lower, for example, if the oxidation temperature has been reduced by an additive or by providing $NO_2$. If the soot is at a temperature which is below its oxidation temperature, then thermal energy is required to trigger the regeneration process. An active regeneration can be started using engine-internal measures, by changing the combustion process so that the exhaust gas is discharged at a higher temperature. In numerous applications, particularly in the non-road field, post-engine measures are preferable in order to produce an active regeneration. In many cases, it is not possible in the context of exhaust emission control to have an influence on the engine-based measures.

DE 20 2009 005 251 U1 discloses an exhaust emission control unit, wherein, for the purpose of actively producing the regeneration of a particle filter, the exhaust gas system is divided into a main exhaust gas system and a secondary exhaust gas system. These two systems form a heating module. A catalytic burner is connected in the secondary system. The catalytic burner heats and subsequently merges the partial exhaust gas flow flowing through the secondary system with the partial exhaust gas flow flowing through the main system. In this manner, the mixed exhaust gas mass flow is at a clearly higher temperature. The increase in the temperature of the exhaust gas flow heats the soot accumulated on the upstream side of the particle filter to a sufficient temperature to trigger the regeneration process. An oxidation catalytic converter having an upstream hydrocarbon injection, which is located in the secondary system, is used as catalytic burner. An exhaust flap controls the exhaust gas mass flow flowing through the secondary system. The exhaust flap sets the cross-sectional area that allows free flow in the main system. An electrothermal heating element is connected upstream of the oxidation catalytic converter. The electrothermal heating element heats the oxidation catalytic converter to its light-off temperature—namely the temperature at which the desired exothermic HC conversion starts to occur on the catalytic surface. The electrothermal heating element is activated when the oxidation catalytic converter has to be heated to its light-off temperature. This document also describes that the catalytic burner connected in the secondary system can be over-sprayed in order to feed hydrocarbons to a second oxidation catalytic converter directly upstream of the particle filter, so that these hydrocarbons can react with the same exothermic reaction on the catalytic surface of this second oxidation catalytic converter. In this manner, a two-step heating of the exhaust gas can be carried out in this previously known emission control installation. The exhaust gas flowing out of the second oxidation catalytic converter is then at the required temperature in order to heat the soot accumulated on the upstream side of the particle filter sufficiently so that the soot oxidizes.

Similarly, it can be desirable to increase the temperature of other exhaust emission control units, for example, of an oxidation catalytic converter or of an SCR stage, in order to bring the latter more rapidly to their operating temperature.

SUMMARY

The problem to be solved is to further develop a more compact heating module for an exhaust-gas purification system.

This problem is solved according to the present disclosure by modifying a heating module to include an overflow pipe section comprising overflow openings in the main section in the inlet area of the heating module. The overflow openings establish a flow connection between the main section and the secondary section.

In a heating module according to the present disclosure, the branch into the secondary section is formed by an overflow pipe section. In one embodiment, the opening of the secondary section into the main section is also formed by an overflow pipe section. The overflow pipe section has overflow openings, which are introduced into the pipe forming the overflow pipe section. Therefore, the exhaust-gas flow which will travel through the secondary section, either entirely or partially, exits the main section and enters the secondary section in the radial direction via the overflow pipe section. The overflow pipe section is located on the inlet side of the secondary section. The design of the inlet into the secondary section using overflow pipe sections allows a branch to be formed. The branch is a portion of the secondary section at a right angle to the main flow direction of the exhaust gas. The outlet-side connection of the secondary section to the main section can be formed in the same manner. In an alternate embodiment, the main section and the secondary section open into a mixing chamber. The mixing chamber is located in the axial direction and thus in the main flow direction of the exhaust gas. In these designs, the longitudinal extent of the secondary section with the catalytic burner can be limited substantially to the necessary length of the oxidation catalytic converter. If, in addition, an electrothermal heating element positioned upstream of the oxidation catalytic converter in the flow direction is associated with the catalytic burner, the length of the secondary section can be limited practically to the required length of the oxidation catalytic converter and of the heating element positioned upstream with respect to said catalytic converter. In the depicted embodiment, the secondary section branches out of the main section at a right angle, comprising a 90-degree deflection, in order to lead the exhaust-gas flow into a secondary section extending parallel to the main section. The deflection is typically located near the longitudinal axis of the secondary section portion with the oxidation catalytic converter so that the HC injector can be located in the area of the deflection. In particular, the HC injector is located in such a manner that its spray cone is directed upstream frontally onto the oxidation catalytic converter, or, if an electrothermal heating element is positioned upstream of said converter, the spray cone is directed onto the heating element. As a result of the foregoing arrangement, no additional space is required in the longitudinal dimension of the heating module for the required flow distance to form the spray cone of the HC injector. In the depicted embodiment, the depth of the deflection is used for the formation of the spray cone.

It is particularly advantageous to use a design in which the heating module comprises an electro thermal heating element positioned upstream of the oxidation catalytic converter. In such design, the heating element can be used to evaporate the fuel introduced via the HC injector into the secondary section before the fuel is supplied to the catalytic surface of the oxidation catalytic converter. Consequently, in such a design, a minimum flow distance is required between the HC injector or its injector nozzle and the oxidation catalytic converter. Here, the required flow distance is used not as a processing section, but most predominantly for the purpose of forming a spray cone, so that the entire, or largely the entire, upstream surface of the heating element is located in the area of the spray cone. Here, the spray cone is typically adjusted so that it is preferably supplied only to the upstream surface of the heating element and not, or at most only secondarily, to wall sections of the secondary section portion positioned upstream in the flow direction.

The overflow pipe section either surrounds the secondary section or is enclosed by the secondary section and extends away therefrom, depending on the design of the heating module. The design of the inlet-side main section branch through an overflow pipe section allows the formation of numerous overflow openings which are distributed preferably uniformly over the circumference of the overflow pipe section. The design of the overflow openings and their arrangement should be selected preferably so that the exhaust-gas flow into the secondary section is distributed as uniformly as possible. The aim is to expose the oxidation catalytic converter arranged in the secondary section or, if present, the electrothermal heating element positioned upstream of said converter, to the most uniform possible flow over the cross-sectional area of the secondary section. In principle, it is also possible to use a design in which the overflow openings extend only over a portion of the jacket surface of the overflow pipe section, for example, only over 180 degrees. Independently of the above-described design of the overflow pipe section, it is advantageous if the cross-sectional area of the overflow openings in total is slightly larger than the cross-sectional area of the main section in the area of the overflow pipe section. As a result, the exhaust-gas counterpressure that occurs in the secondary section due to the required inserts can be kept low. According to an exemplary embodiment, the total of the cross-sectional areas of the overflow openings is 1.2 to 1.5 times larger than the cross-sectional area of the overflow pipe. A cross-sectional area ratio of approximately 1.3 is particularly advantageous, in order not to have an excessively disadvantageous influence on the flow behavior through the two sections—the main section and the secondary section.

The design of the connection of the secondary section via overflow pipe sections allows the exhaust-gas to undergo only a minimal and thus negligible exhaust-gas counter pressure buildup at the branches as it flows through the main section of the heating module. This result is achieved by corresponding the dimensions of the overflow openings, in particular with regard to their number and their diameter, with the dimensions of the overflow pipe.

The overflow pipe limits the main section, depending on the design of the heating module and its location on the outside or inside. In the first embodiment, the exhaust gas is led in the radial direction outward from the main section into the secondary section. The oxidation catalytic converter and optional heating element positioned upstream of said converter are located in a pipe arranged parallel to the main section, as secondary section. According to a second embodiment, the secondary section is located inside the main section, preferably in a concentric arrangement relative to the main section. The transition from the main section to the secondary section in this design occurs in the radial direction toward the interior. In an embodiment where the secondary section with the catalytic burner is located inside the main section both the exhaust-gas flowing through the secondary section and some exhaust-gas flowing through the main section are heated during the operation of the catalytic burner in the secondary section. This occurs because exhaust-gas flowing through the main section flows past the outer jacket surface of the secondary section containing the catalytic burner. Thus, no additional heat loss needs to be tolerated. Moreover, the temperature difference between the exhaust-gas flowing out of the secondary section and the exhaust-gas flowing through the main section is less when the two streams are merged, which in turn produces an advantageous effect on rapid mixing, and the resulting temperature uniformity achieved in the total exhaust-gas flowing in the connection to the outlet of the secondary section.

The exhaust-gas flow led through the secondary section can return into the main flow analogously to the entrance at the inlet of the secondary section via a second overflow pipe section comprising overflow openings. The foregoing explanations regarding the inlet-side overflow pipe apply equally to the overflow pipe section on the outlet side of the secondary section. The introduction of the exhaust-gas flow flowing out of the secondary section into the main section, or into the exhaust-gas flow flowing through the latter main section, ensures a particularly effective mixing of the two exhaust-gas flows over a very short distance. Stated differently, the mixed exhaust-gas flow has a very uniform temperature distribution relative to its cross-sectional area after a very short flow distance beyond the outlet-side overflow pipe.

In an exemplary embodiment where the secondary section, which includes the oxidation catalytic converter and the electrothermal heating element upstream of said converter, extends parallel to the main section, the fluid connection between the main section and the secondary section is achieved by overflow deflection chambers. Said chambers contact the main section through an overflow pipe section. The secondary section with its inserts is separately connected to the overflow deflection chambers. The overflow deflection chambers constitute a portion of the secondary section. Such an embodiment allows for the diameter of the secondary section with its inserts to be greater than the diameter of the main section. Accordingly, an oxidation catalytic converter having a correspondingly large diameter can be connected in such a secondary section. Here, it is understood that, the greater the cross-sectional area of the oxidation catalytic converter is, the shorter said converter can be in terms of its length, and still function at equal volume. This creates not only the possibility of designing the heating module so that its construction is accordingly shorter in length, but also reduces the counter pressure and the conversion rate, and thus the temperature stress on the oxidation catalytic converter.

In principle, the advantages are the same, with the exception of the mentioned overflow pipe sections, in a heating module in which the secondary section has a deflection chamber on each of the input side and the output side that extends in a radial direction from the main section. In this embodiment, the secondary section with the oxidation catalytic converter is located between the deflection chambers, parallel to the main section of the heating module. The foregoing arrangement constitutes an additional solution of the problem that is the basis of this disclosure.

In one embodiment, the deflection chambers are formed from assembling two metal plate parts formed by deep drawing. The design of the fluid connections between the secondary section, including the oxidation catalytic converter and the electro thermal heating element, with the main section through the foregoing deflection chambers allows for the described deflection chambers. This design allows the use of identical parts for the inlet-side and outlet-side deflection chambers, at least with regard to a pre-manufacturing step. The openings for the deflection chamber parts can differ from each other after this premanufacturing step for the connection of, for example, sensors, or, for example, an HC injector. In principle, the external deflection chamber parts can also be identical. It is only in the case of the external deflection chamber part located on the inlet-side that connection means for attaching the HC injector are typically provided. According to an exemplary embodiment, this inlet-side deflection chamber part has an injector opening with a neck which is crimped outward, to which the HC injector is attached. This inlet-side deflection chamber part can be manufactured identically to the external deflection chamber part of the outlet-side deflection chamber. The HC injector opening is then produced by an additional process step to the inlet-side deflection chamber.

Additional advantages and advantageous embodiments of the invention can be obtained in the following description of an embodiment example in reference to the appended figures.

DETAILED DESCRIPTION OF THE DRAWINGS

Figure 1:
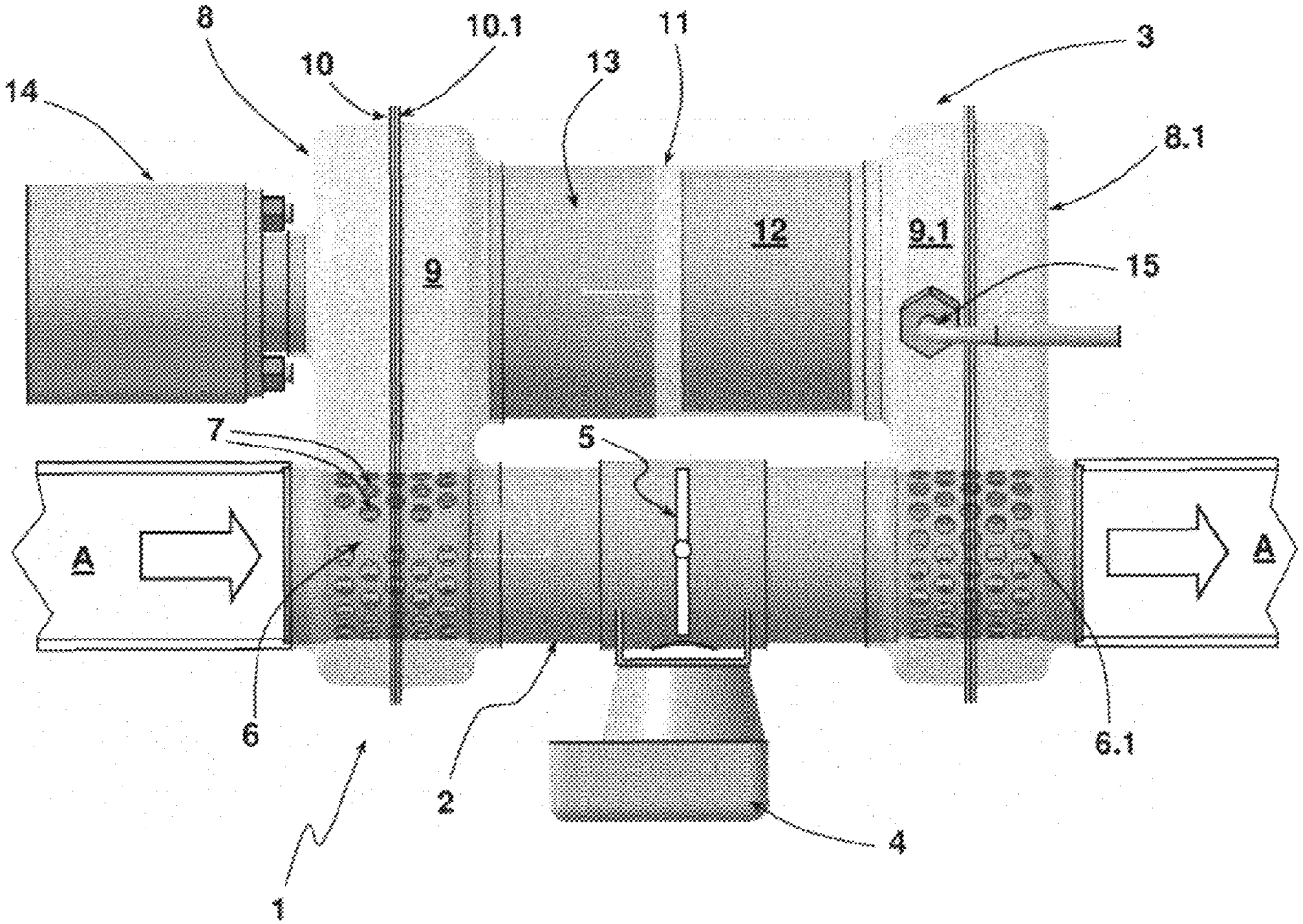
FIG. 1: shows a diagrammatic elevation and inside view of a heating module according to a first embodiment example for feeding thermal energy into the exhaust-gas section of an exhaust-gas purification system connected to the outlet of an internal combustion engine.

The heating module 1 of a first exemplary embodiment is connected in an exhaust-gas section—not shown in further detail—of an exhaust-gas purification system. The exhaust-gas purification system is in turn connected to the outlet of an internal combustion engine (not shown). In the depicted embodiment, the internal combustion engine is a diesel engine as. The exhaust-gas section in which the heating module 1 is connected is marked with the reference numeral A. Heating module 1 is located upstream in the direction of flow, represented by block arrows in FIG. 1, of an exhaust-gas purification unit, for example, a particle filter in the direction of flow of the exhaust gas. Preferably, an oxidation catalytic converter is positioned upstream of the particle filter.

The heating module 1 according to a first exemplary embodiment of the invention comprises a main section 2 and a secondary section 3. The main section 2 is a portion of the exhaust-gas section A of the exhaust-gas purification system. The exhaust gas discharged by the diesel engine flows through the main section 2 of the heating module 1, when said gas is not led through the secondary section 3. If the heating module 1 is used for feeding thermal energy into the exhaust-gas section A, at least a portion of the exhaust-gas flow is directed through the secondary section 3. An exhaust-gas flap 5, which can be actuated by an actuator 4, is located in the main section 2 for controlling the exhaust-gas flow through the main section 2 and/or the secondary section 3. In FIG. 1, the exhaust-gas flap 5 is shown in a position closing the main section 2. Depending on the position of the exhaust-gas flap 5 within the main section 2, the entire exhaust-gas flow can be directed through the main section 2 or through the secondary section 3. Alternatively, a partial exhaust-gas flow can be directed through the main section 2 and the complementary partial flow can be directed through the secondary section 3.

The main section 2 of the heating module 1 includes an overflow pipe section 6, 6.1 on the inlet and outlet sides of the secondary section 3. The overflow pipe section 6, 6.1 of the exemplary embodiment comprises a plurality of overflow openings 7 extending through overflow pipe section 6, 6.1. In the exemplary embodiment, overflow openings 7 have a circular cross-sectional geometry. In the depicted embodiment, overflow openings 7 are distributed over the circumference of overflow pipe section 6, 6.1 in a uniform grid. In the depicted embodiment, overflow openings 7 are designed with equal cross-sectional area. It should be understood that the arrangement of the overflow openings 7, their cross-sectional geometry and also their size are variable. It should also be understood that, overflow openings 7 can be arranged differently over the overflow pipe section 6, 6.1, typically in the flow direction of the exhaust gas. In the depicted embodiment, the sum of the cross-sectional areas of the overflow openings 7 is approximately 1.3 times as large as the cross-sectional area of the main section 2, typically measured near overflow pipe section 6. In the depicted embodiment, overflow pipe section 6.1, located on the outlet-side of secondary section 3, is designed identically to overflow pipe section 6. The design of the outlet-side overflow pipe section 6.1, however, can also be designed differently from the inlet-side overflow pipe section 6.

The overflow pipe section 6 is surrounded by an overflow deflection chamber 8. In the depicted embodiment, overflow deflection chamber 8 surrounds the circumference of overflow pipe section 6, because, in the depicted embodiment, overflow openings 7 are distributed circumferentially over overflow pipe section 6. As a result, all the overflow openings 7 of the overflow pipe section 6 are located inside the overflow deflection chamber 8. Due to this measure, exhaust gas can flow out of the main section 2 into the secondary section 3 over the entire circumference of the overflow pipe section 6. The overflow deflection chamber 8 consists of two metal plates formed by deep drawing, namely deflection chamber parts 9, 9.1. Each deflection chamber part 9 has a mounting flange 10, 10.1 by means of which the two deflection chamber parts 9 are connected together in a sealing manner by a bonding technique. Overflow pipe section 6.1 is surrounded in the same manner by an overflow deflection chamber 8.1.

In parallel and at distance from the main section 2, between the deflection chamber parts 9, 9.1 of the overflow deflection chambers 8, 8.1 which are directed toward each other, a secondary section portion 11 extends, which, in the depicted embodiment, is designed as a pipe with a circular cross-sectional geometry. An oxidation catalytic converter 12 is located in secondary section portion 11. An electro thermal heating element 13 is positioned upstream of oxidation catalytic converter 12 in the direction of flow. The required connections for operating the heating element 13 are not represented in the figures for the sake of simplicity. An HC injector 14 is connected to deflection chamber part 9 of overflow deflection chamber 8. HC injector 14 is used for spraying in fuel (here: diesel), in order to provide hydrocarbons for the operation of the catalytic burner formed from the combination of HC injector 14 and oxidation catalytic converter 12. HC injector 14 is connected in a manner not shown in further detail to the fuel supply which also supplies the diesel engine.

The above-described shell design of the overflow deflection chambers 8, 8.1 makes it possible to form said chambers from identical parts.

In the depicted embodiment, an opening is located in the deflection chamber part 9 in order to connect HC injector 14. Deflection chamber part 9.1 of the other overflow deflection chambers 8 includes an opening for receiving a temperature sensor connection (not shown). The opening in deflection chamber part 9.1 is in alignment with the longitudinal axis of the secondary section portion 11.

Figure 2:
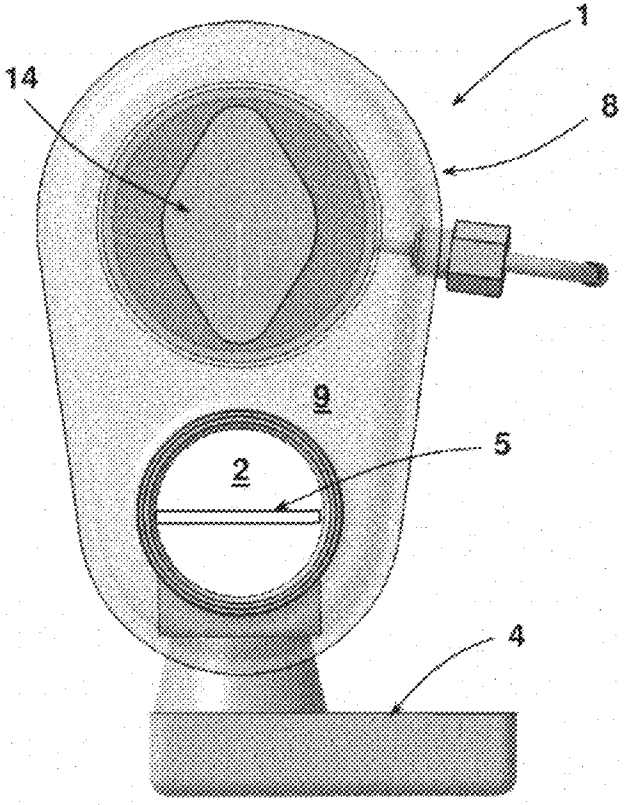
FIG. 2: shows a first front side view (side view from the left) of the heating module of FIG. 1, FIG. 3: shows an additional front side view (side view from the right) of the side of the heating module of FIG. 1 which is located opposite the side view of FIG. 2, FIG. 4: shows a representation corresponding to that of FIG. 1 with flow arrows included in the drawing, during the operation of the heating module.
Figure 3:
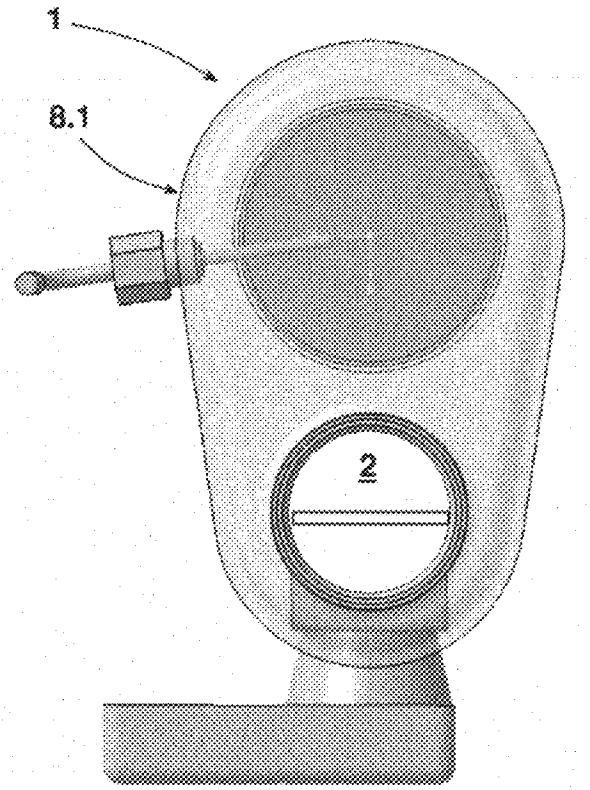

FIGS. 2 and 3 depict side views of heating module 1. These figures show that flow cross-sectional area of overflow deflection chambers 8, 8.1 increase in size from main section 2 to secondary section portion 11. This increase in cross-sectional area produces, on the inlet side, a slowing of the exhaust-gas flow through the secondary section 3. This is desirable to avoid disrupting the spray cone formed by the HC injector 14 as it injects fuel with the inflowing exhaust-gas flow. The fuel cone sprayed in by the HC injector 14 is designed to wet the upstream front side of the heating element 13 with fuel. The spray cone is angled such that wall sections of the secondary section portion 11 located before the heating element 13 in the direction of flow are wetted with fuel. As shown in FIGS. 1-3, the cross-sectional area of the secondary section portion 11 is again slightly smaller than the flow cross-sectional area within the overflow deflection chambers 8 (the same applies to the overflow deflection chambers 8.1) in the area of the horizontal crest of the secondary section portion 11 shown in FIGS. 2 and 3. The consequence of the foregoing is that, moving into the secondary section portion 11, the exhaust-gas flow introduced into the secondary section 3 is accelerated, which results in any spray-off of the HC injector 14 being pulled into the secondary section portion 11 and led to the electro thermal heating element 13, consequently avoiding undesired deposits on the wall.

In the side view of the heating module 1 of FIGS. 2 and 3, the exhaust-gas flap 5 is pivoted 90 degrees with respect to the representations of FIG. 1. In this position, the exhaust gas applied to the heating module 1 flows in its entirety through the main section 2. The reason for this is that the exhaust-gas counter pressure opposing the exhaust-gas flow applied to the heating module 1 through the secondary section 3 is slightly greater than through the main section 2 and the components of the exhaust-gas purification system 1 which are downstream of the heating module 1.

In the depicted embodiment, the cross-sectional area of the secondary section portion 11 is slightly more than twice as large as the cross-sectional area of the main section 2. In order to form a heating module 1 having as compact a construction as possible, the cross-sectional areas of the inserts—heating element 13 and oxidation catalytic converter 12—and especially the oxidation catalytic converter 12, must have a relatively short length in the direction of flow of the exhaust gas. It has been shown that, especially in the longitudinal length of an exhaust-gas section, the installation space is often limited, while in the transverse direction to said longitudinal length, certain units can be accommodated. Due to the above-described design, the heating module 1 satisfies this requirement to a particular degree.

The overflow deflection chamber 8.1 includes a temperature sensor 15, by means of which the, exhaust-gas temperature can be determined on the outlet side with respect to the oxidation catalytic converter 12.

It is clear from the representation of FIGS. 1-3 that the actuator 4 does not have to be located, as represented in the figures, on the bottom side of the heating module 1; rather, the actuator 4 can be located in one or the other direction rotated about the longitudinal axis of the main section 2, depending on the location of the required installation space in a given application.

Below, the operation of the heating module 1 is briefly described. The heating module 1 is operated by feeding thermal energy into the exhaust-gas flow of the diesel engine, for example, in order to trigger and optionally control a regeneration of a particle filter connected in the exhaust-gas purification system downstream of heating module 1. If the exhaust gas discharged by the diesel engine has exceeded a certain temperature, a portion of the exhaust-gas flow or the entire exhaust-gas flow is led through the secondary section 3 during the actual operation of the heating module 1. This serves the purpose of preheating oxidation catalytic converter 12, to the extent possible by the heat of the exhaust-gas flow, and of bringing said converter to its operating temperature, if the temperature of the exhaust gas is sufficiently high. If it is impossible to bring the oxidation catalytic converter 12 to its light-off temperature by this measure, the electro thermal heating element 13 is additionally supplied with current, so that the oxidation catalytic converter is heated via the exhaust-gas flow heated by the heating element 13.

If the heating module 1 is the first portion of a two-step catalytic burner arrangement, it is preferable to design the oxidation catalytic converter 12 with a higher oxidation catalytic load than the oxidation catalytic converter positioned downstream with respect to the former converter, in the main section. Consequently, in such a design, the light-off temperature of this oxidation catalytic converter 12 is lower.

For the actual operation of the heating module 1, depending on the temperature rise to be achieved, either all the exhaust gas supplied to the heating module 1, or only a portion thereof, is led through the secondary section 3. Accordingly, the exhaust-gas flap 5 in the main section is set by means of the actuator 4. Here, it is understood that, when the exhaust-gas flap 5 in the main section is in its closed position, the predominant portion of the exhaust-gas flow flows through the secondary section 3. Conversely: If the exhaust-gas flap is in its completely open position, as can be seen in the side view of FIG. 2, the entire exhaust-gas flow flows through the main section 2 of the heating module 1. During the operation of the heating module 1, the exhaust gas flowing through the secondary section 3 is heated due to the operation of the catalytic burner connected therein, which is formed in the represented embodiment example by the HC injector 14, the heating element 13, and the oxidation catalytic converter 12. For this purpose, the electrical heating element 13 is supplied with current, so that the fuel injected through the HC injector 14 evaporates on said element. The spray cone S of the HC injector 14 is indicated diagrammatically in the drawing of FIG. 4. The fuel evaporated on the heating element 13 is supplied to the catalytic surface of the oxidation catalytic converter 12 and it triggers the desired exothermic reaction. The exhaust-gas flow heated in this manner by the secondary section 3 is returned via the overflow deflection chamber 8.1 into the main section 2, wherein a particularly effective mixing occurs over a short distance, as this hot exhaust-gas flow passes through the overflow openings 7 into the clearly cooler partial exhaust-gas flow flowing through the main section 2.

It is understood that, through the HC injector 14, fuel is injected into the secondary section 3 only when the oxidation catalytic converter 12 is at a temperature above its light-off temperature.

Figure 4:
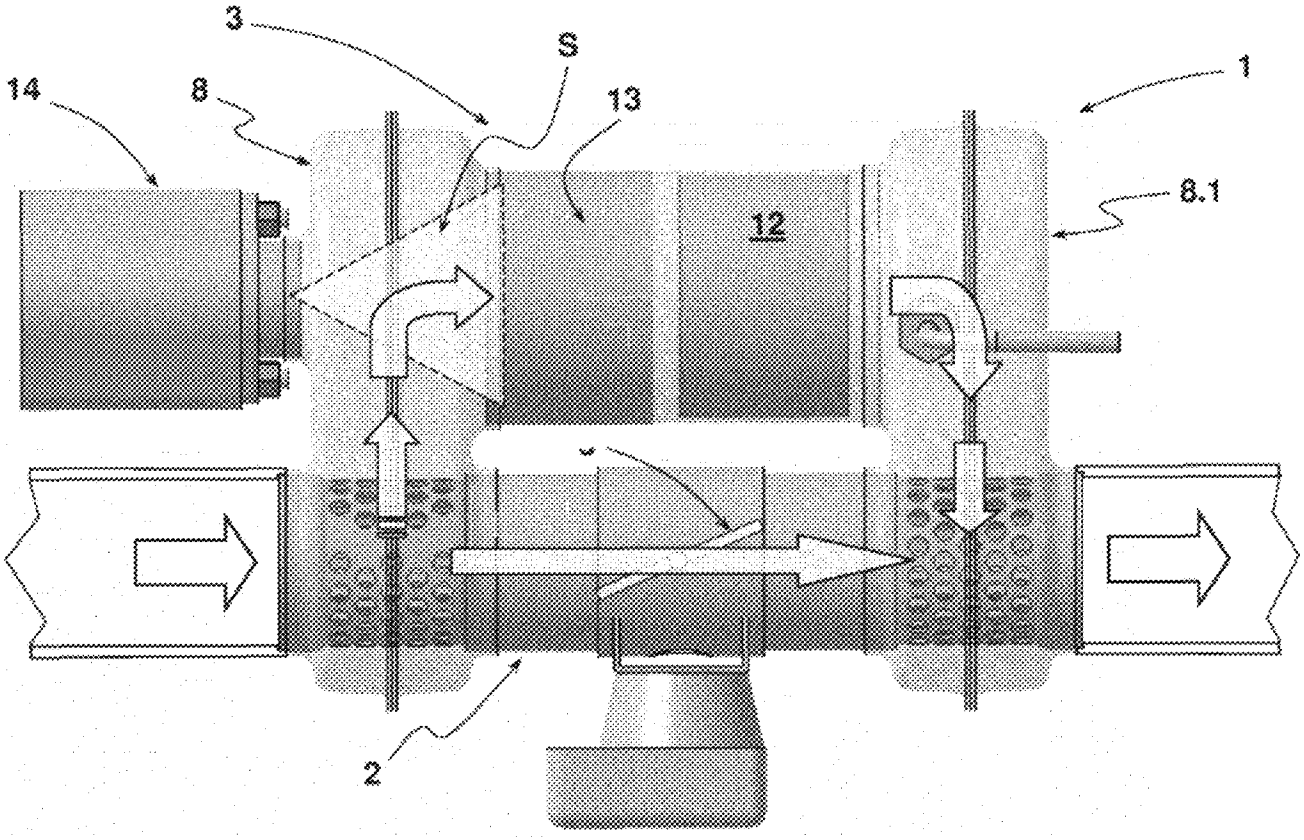
Figure 5:
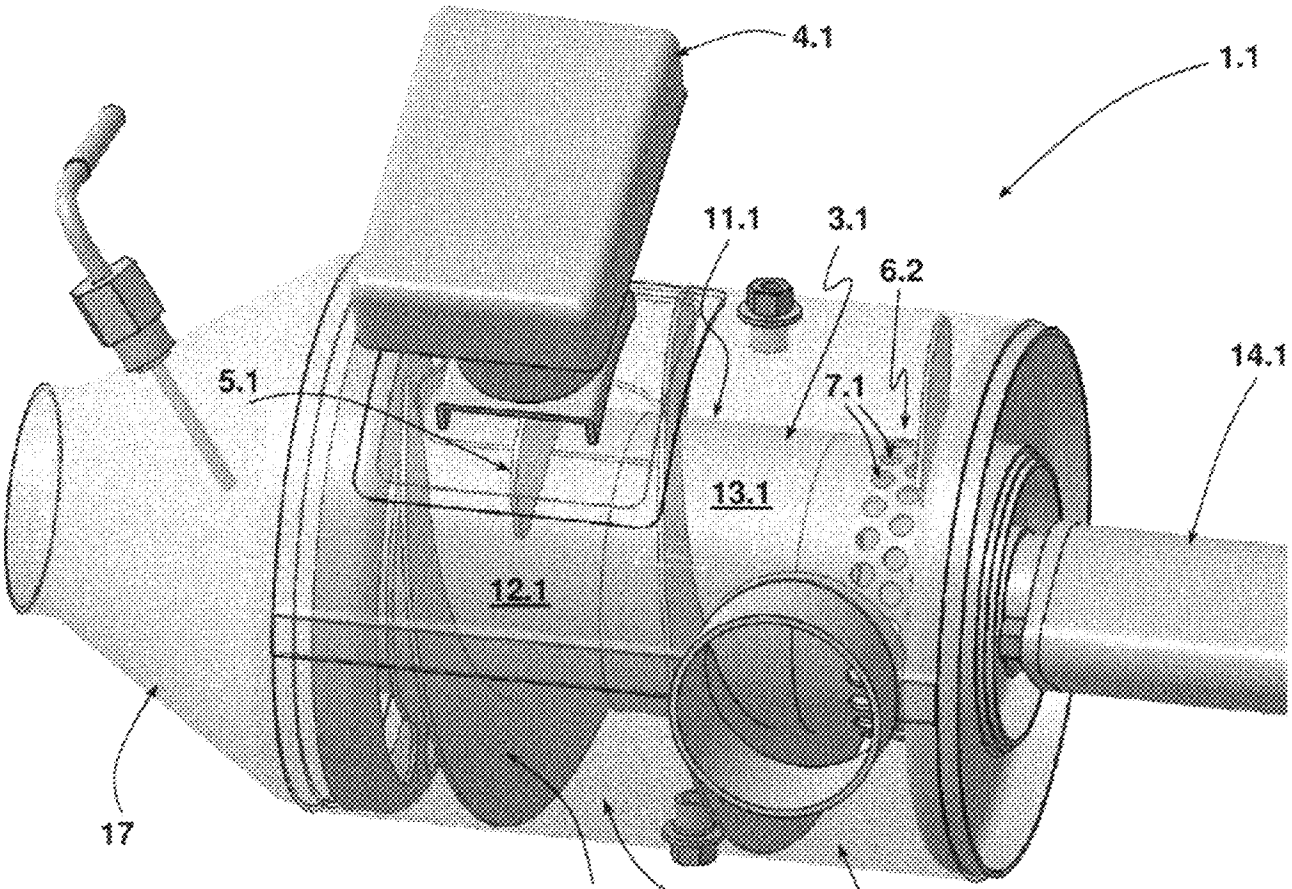
FIG. 5: shows a perspective elevation and inside view of a heating module according to an additional embodiment example for feeding thermal energy into the exhaust-gas section of an exhaust-gas purification system connected to the outlet of an internal combustion engine.

FIG. 5 shows an additional heating module 1.1 according to an additional embodiment of the invention. In principle, the heating module 1.1 is constructed like the heating module 1 of FIGS. 1-4. Therefore, the explanations pertaining to the heating module 1 also apply to the heating module 1.1, unless otherwise explained below.

In the heating module 1.1, the secondary section portion 11.1, with the oxidation catalytic converter 12.1 and the heating element 13.1 which is positioned upstream of said converter, is located within the main section 2.1. In this design and in the depicted embodiment of heating module 1.1, the main section 2.1 and the secondary section 3.1 are in a concentric arrangement with respect to each other. The exhaust-gas section A opens, in the depicted embodiment, radially into the main section 2.1. The main section 2.1, owing to the concentric arrangement, is limited in the radial direction on the inside by the secondary section 3.1. In the area of the inlet of the heating module 1.1, an overflow pipe section 6.2 is positioned upstream of the secondary section portion 11.1. The overflow pipe section 6.2 is also formed like the overflow pipe section 6, 6.1 of the first embodiment depicted in FIGS. 1-4. Therefore, the explanations of overflow pipe section 6, 6.1 also apply to the overflow pipe section 6.2 of the heating module 1.1. The overflow openings 7.1 are introduced circumferentially into the overflow pipe section 6.2, and, in the depicted embodiment, they have a circular cross-sectional geometry. Thus, the overflow pipe section 6.2 or its overflow openings 7.1 form(s) the inlet and thus the flow connection between the main section 2.1 and the secondary section 3.1. In contrast to heating module 1, in heating module 1.1, the exhaust-gas flow which is to be led through the secondary section 3.1, exits in the radial direction on the inside, and thus from the inner jacket surface of the main section 2.1 and into the secondary section 3.1. The injection nozzle of an HC injector 14.1 is located in an axial arrangement with respect to the secondary section 3.1, like the HC injector 14 of the heating module 1. The inlet opening for the inflow of the exhaust gas into the main section can alternatively be designed to be tangential or axial relative to the main flow direction of the exhaust gas through the heating module 1.1. In an axially arranged inlet opening, this opening can be designed in the form of a ring, if desired.

The electrical connections for heating element 13.1 are not shown in heating module 1.1, for simplicity's sake.

Main section 2.1 surrounds secondary section 3.1 and thus forms a ring chamber. Into this ring chamber, a helix 16 is inserted as a guide element by means of which the exhaust-gas flow flowing in the radial direction into the main section 2.1 is given a rotatory movement component. Therefore, owing to this design, the exhaust-gas flow flowing through the main section 2.1 is given a rotatory movement. Due to the helix 16, which extends over the entire height of the ring chamber, at the same time, a flow channel extending in the form of a helix is formed around secondary section 3.1. In the depicted embodiment, an exhaust-gas flap 5.1 is placed in this channel. Exhaust-gas flap 5.1 is controlled by an actuator 4.1, as in the embodiment depicted in FIGS. 1-4. Exhaust-gas flap 5.1 can be swiveled about a rotation axis that extends radially with respect to the longitudinal axis of the secondary section 3.1. In FIG. 5, exhaust-gas flap 5.1 is shown in its open position. Due to the formation of the flow channel by the helix 16, the exhaust-gas flow led through the main section 2.1 is led around the jacket surface of the secondary section 3.1. This longer flow path has the advantage that, depending on the operation state, the inflowing exhaust gas heats the oxidation catalytic converter 12.1 located in the secondary section 3.1, and therefore the oxidation catalytic converter 12.1 is typically at least approximately at the temperature of the exhaust gas. Therefore, in the depicted embodiment, it is not necessary to lead the exhaust-gas flow or a portion thereof through the secondary section 3.1 in order to preheat the oxidation catalytic converter 12.1 before the operation of the catalytic burner. If the catalytic burner is in operation, the heat released by the secondary section portion 11.1 is not transferred to the environment but to the partial exhaust-gas flow flowing through the main section 2.1. It is understood that, for the purpose of heating the oxidation catalytic converter 12.1, on the one hand, and the partial exhaust-gas flow flowing through the main section 2.1, on the other hand, the longer flow distance of the main section, due to the flow chamber formed by the helix 16, ensures a particularly effective heat transfer.

Figure 6:
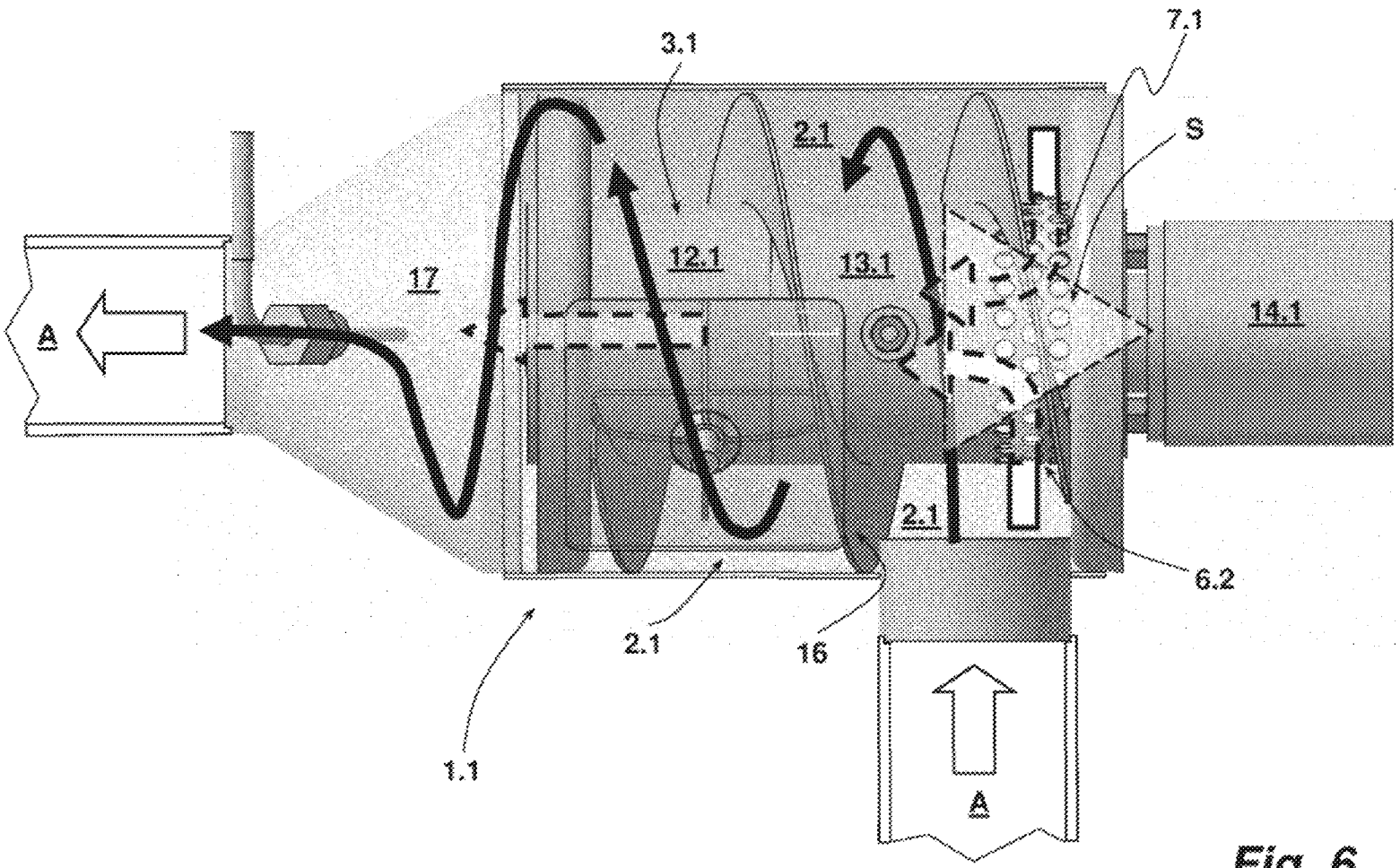
FIG. 6: shows a diagrammatic elevation and inside view of the heating module of FIG. 5 with flow arrows included in the drawing, during the operation of the heating module.

FIG. 6 depicts operation of heating module 1.1, which in principle, corresponds to FIG. 4 showing heating module 1. In this figure, flow arrows are recorded in a diagrammatic elevation and inside view. The exhaust-gas flow flowing through the overflow openings 7.1 of the overflow pipe section 6.2 into the secondary section 3.1 is identified by the arrows framed by a broken line because the exhaust-gas flow in this regard is located within the secondary section 3.1. Exhaust-gas flap 5.1 is located in the main section 2.1 in a position rotated by 90 degrees with respect to FIG. 5 for the purpose of increasing the exhaust-gas counter pressure. In this position, exhaust-gas flap 5.1 does not close the flow channel completely, as explained below in reference to FIGS. 7*a*, 7*b*, so that a smaller partial exhaust-gas flow flows through the main section 2.1. The rotation of this partial exhaust-gas flow around the secondary section 3.1 is represented diagrammatically by arrows.

Figure 7B:
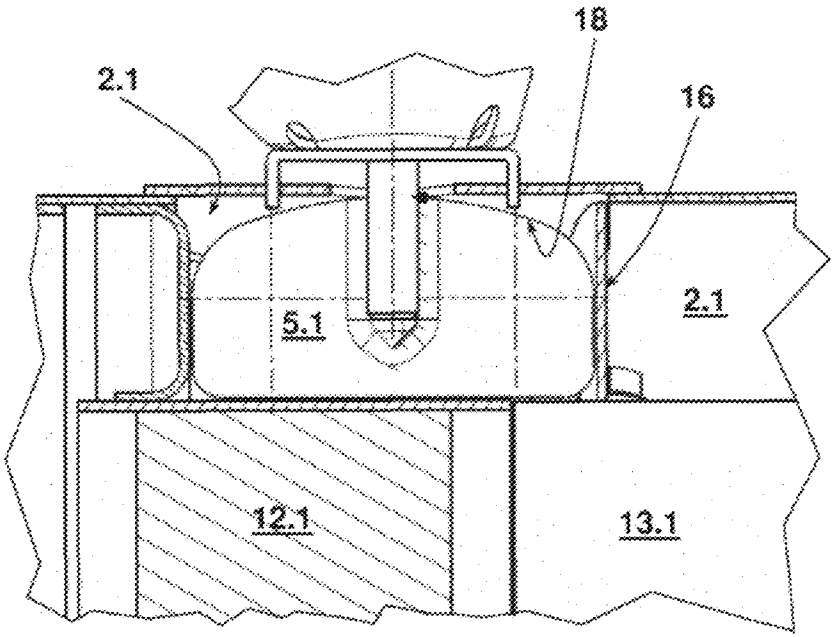
FIG. 7*a*, 7*b*: show a cross-sectional representation of the heating module of FIGS. 5 and 6 (FIG. 7*a*) as well as a detail of a longitudinal section of the mentioned heating module (FIG. 7*b*) in the area of the arrangement of an exhaust-gas flap.
Figure 7A:
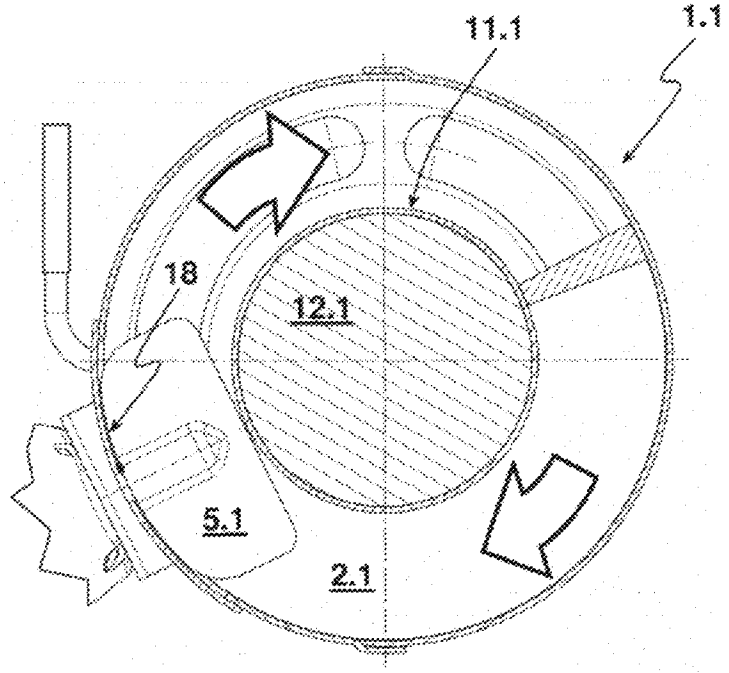

FIG. 7*a* is a cross-sectional longitudinal view through heating module 1.1 shortly before the exhaust-gas flap 5.1 showing the geometry of the exhaust-gas flap 5.1 in its open position (see also FIG. 5). The rotatory flow of the exhaust-gas flow through main section 2.1 is indicated by block arrows. One can also easily see the concentric arrangement of secondary section portion 11.1, with oxidation catalytic converter 12.1 arranged in the sectional plane with respect to main section 2.1. Exhaust-gas flap 5.1 in the radial direction toward the outside comprises a curved closure 18 which is adapted to the curvature of the housing surrounding the main section 2.1. If exhaust-gas flap 5.1 is in its closed position, as shown in FIG. 7*b*, main section 2.1 is not completely closed by the exhaust flap 4.1, owing to the closure 18, so that, in this position, a certain partial exhaust-gas flow flows through the main section 2.1 past the exhaust-gas flap 5.1.

A perforated metal plate (not shown) is located at the outlet of the secondary section 3.1. Both main section 2.1 and secondary section 3.1 open into a mixing chamber 17 which narrows conically. Into the latter chamber, the partial exhaust-gas flow led through main section 2.1 flows in the form of a rotating ring-shaped flow, which surrounds the exhaust-gas flow leading into the mixing chamber 17 as it flows into the secondary section 3.1. The constriction formed by the narrowing of mixing chamber 17 and the swirling of the partial exhaust-gas flow leading into said mixing chamber through main section 2.1 produce a particularly effective mixing of the two partial exhaust-gas flows over a very short distance. When the two partial exhaust-gas flows are merged, the partial exhaust-gas flow flowing out of secondary section 3.1 can also enter mixing chamber 17, in the form of a concentric ring-shaped flow with respect to the partial exhaust-gas flow exiting the main section 2 through an appropriate aperture 1. In such an arrangement, one or more additional guide elements are provided so the partial exhaust-gas flow exiting the secondary section 3.1 in the form of a swirling flow can also lead into the mixing chamber 17, wherein, for the purpose of an intensive mixing, the swirling of the partial exhaust-gas flow flowing out of the secondary section 3.1 is oriented in a direction opposite the swirling of the partial exhaust-gas flow flowing through the main section 2.1. It is also possible that the partial exhaust-gas flows comprise, as a result of corresponding guide elements, radial flow components directed against each other, at the time of the flow into the mixing chamber 17.

In FIG. 6, the spray cone S of HC injector 14.1 is also shown diagrammatically. Radial inflow of the exhaust gas from main section 2.1 through overflow opening 7.1 into secondary section 3.1 effectively prevents spray-off deposits of the HC injector 14.1 on the inner side of the overflow pipe section 6.2 and the secondary section portion 11.1 abutting the former section.

The design on which the heating module 1.1 is based ensures not only a temperature efficient design of the heating module but also a special space-saving design.

In the embodiment depicted in FIGS. 5 and 6, the mixing chamber 17 connected to the outlets of the two sections 2.1, 3.1 narrows conically in the main flow direction of the exhaust gas. Such a narrowing is not required. Rather, the mixing chamber can also be designed cylindrically, and to this cylindrical section it is possible to connect, after a short flow distance, the exhaust-gas purification unit to which the heat generated by the heating module 1.1 is to be supplied.

The invention is described in reference to embodiment examples. Without going beyond the scope of the valid claims, the person skilled in the art will be able to derive numerous additional designs embodying the invention, which do not need to be explained in detail in the context of this description. Nonetheless, these designs are also part of the disclosure content of these explanations.

LIST OF REFERENCE NUMERALS

1, 1.1 Heating module
2, 2.1 Main section
3, 3.1 Secondary section
4, 4.1 Actuator
5, 5.1 Exhaust-gas flap
6, 6.1, 6.2 Overflow pipe section
7, 7.1 Overflow opening
8, 8.1 Overflow deflection chamber
9, 9.1 Deflection chamber part
10, 10.1 Mounting flange
11, 11.1 Secondary section portion
12, 12.1 Oxidation catalytic converter
13, 13.1 Heating element
14, 14.1 HC injector
15 Temperature sensor
16 Helix
17 Mixing chamber
18 Closure
A Exhaust-gas section
S Spray cone

The invention claimed is:

1. A heating module for an exhaust-gas purification system connected to the outlet of an internal combustion engine, comprising:

a catalytic burner, comprising an HC injector, an oxidation catalytic converter positioned downstream of the HC injector in a direction of flow of the exhaust gas, for supplying thermal energy to an exhaust-gas purification unit of an exhaust-gas purification system;

a heating module comprising a main section, a secondary section containing the catalytic burner and a device for controlling the exhaust-gas mass flow flowing through the secondary section; wherein the main section, in an inlet area of the heating module, comprises an overflow pipe section further comprising overflow openings, through which overflow openings a flow connection is established between the main section and the secondary section, and wherein the sum of the cross-sectional areas of the overflow openings of the overflow pipe section is greater than a cross-sectional area of the main section in the overflow pipe section.

2. The heating module according to claim 1, wherein the overflow openings are arranged in an even distribution over a circumference of the overflow pipe section.

3. The heating module according to claim 1, wherein a sum of the cross-sectional areas of the overflow openings of the overflow pipe section is 1.2-1.5, in particular 1.3 times greater than the cross-sectional area of the main section in the overflow pipe section.

4. The heating module according to claim 1, wherein the main section and the secondary section are arranged concentrically with respect to each other.

5. The heating module according to claim 4, wherein the main section and the secondary section open in an axial direction into a mixing chamber.

6. The heating module according to claim 5, wherein the mixing chamber narrows in the main direction of flow of the exhaust gas.

7. The heating module according to claim 5, wherein the secondary section opens, with insertion of a perforated metal plate, into the mixing chamber.

8. The heating module according to claim 5, wherein:

the secondary section, with the insertion of an aperture, opens into the mixing chamber; and wherein the aperture opening has a ring structure.

9. The heating module according to claim 5, wherein:

the secondary section, which is positioned downstream of the catalytic burner, has at least one guide element which has an influence on the exhaust-gas flow flowing through the secondary section; and wherein due to said guide element, the exhaust-gas flow flowing from the secondary section into the mixing chamber receives a rotatory movement component.

10. The heating module according to claim 4, wherein at least one metal plate is inserted in the main section; wherein said metal plate is in the shape of a helix in at least some sections; and wherein through which metal plate the exhaust-gas flow flowing through the main section receives a rotatory movement component.

11. The heating module according to claim 1, wherein the secondary section, on the outlet side, is in a fluid connection with the main section via a second overflow pipe section comprising overflow openings.

12. The heating module according to claim 1, wherein an atomization nozzle of the HC injector is aligned with the longitudinal axis of the secondary section portion containing the oxidation catalytic converter.

13. The heating module according to claim 1, wherein:

the secondary section includes an electrothermal heating element; and the electrothermal heating element is located downstream of the HC injector and upstream of the oxidation catalytic converter in the direction of flow of the exhaust gas.

14. The heating module according to claim 1, wherein the device for controlling the exhaust-gas mass flow flowing through the secondary section is located in the main section of the heating module.

15. A heating module for an exhaust-gas purification system connected to the outlet of an internal combustion engine, comprising:

a catalytic burner, comprising an HC injector, an oxidation catalytic converter positioned downstream of the HC injector in a direction of flow of the exhaust gas, for supplying thermal energy to an exhaust-gas purification unit of an exhaust-gas purification system;

a heating module comprising a main section, a secondary section containing the catalytic burner and a device for controlling the exhaust-gas mass flow flowing through the secondary section; wherein the main section, in an inlet area of the heating module, comprises an overflow pipe section further comprising overflow openings, through which overflow openings a flow connection is established between the main section and the secondary section;

wherein:

the overflow sections are each surrounded by one overflow deflection chamber extending in the radial direction away from the main section; and wherein the secondary section portion with the oxidation catalytic converter is located between the overflow deflection chambers; and wherein the secondary section portion is parallel to the main section of the heating module.

16. A heating module for an exhaust-gas purification system connected to the outlet of an internal combustion engine, comprising:

a catalytic burner comprising an HC injector and an oxidation catalytic converter positioned downstream of the HC injector in the direction of flow of the exhaust gas, for supplying thermal energy to an exhaust-gas purification unit of the exhaust-gas purification system; wherein the heating module comprises a main section, a secondary section containing the catalytic burner and a device for controlling the exhaust-gas mass flow flowing through the secondary section; wherein the secondary section having an inlet side and outlet side;

a deflection chamber on each of the inlet side and outlet side;

said deflection chambers extending, in a radial direction, away from the main section; wherein the secondary section portion with the oxidation catalytic converter is located between said deflection chambers parallel to the main section of the heating module; and the cross-sectional area of the inlet-side deflection chamber broadens in the direction of flow of the exhaust gas;

the cross-sectional area of the outlet-side deflection chamber narrows in the direction of flow of the exhaust gas;

said deflection chambers have a larger cross-sectional area than said secondary section portion; and the secondary section portion with the oxidation catalytic converter is located between the sections of the deflection chambers.

17. The heating module according to claim 16, wherein the cross-sectional area of the secondary section portion with the oxidation catalytic converter, which extends between the deflection chambers, is more than twice as large as the cross-sectional area in the main section.

18. The heating module according to claim 16, wherein the deflection chambers each consist of two mutually connected metal plate formed parts.

19. The heating module according to claim 18, wherein the deflection chambers comprise identical parts, at least partially in regard to the deflection chamber parts forming said chambers, at least in a pre-manufacturing stage.

20. The heating module according to claim 18, wherein the deflection chamber part located on the outside of the input-side deflection chamber comprises an HC injector opening with a neck crimped outward, for connection of the HC injector.

* * * * *